US011473253B2

(12) United States Patent
Wang

(10) Patent No.: US 11,473,253 B2
(45) Date of Patent: Oct. 18, 2022

(54) CONCRETE DECK DEMOLITION SYSTEM AND METHOD

(71) Applicant: Wei Wang, New York, NY (US)

(72) Inventor: Wei Wang, New York, NY (US)

( * ) Notice: Subject to any disclaimer, the term of this patent is extended or adjusted under 35 U.S.C. 154(b) by 123 days.

(21) Appl. No.: 17/079,086

(22) Filed: Oct. 23, 2020

(65) Prior Publication Data

US 2021/0123195 A1 Apr. 29, 2021

Related U.S. Application Data

(60) Provisional application No. 62/925,184, filed on Oct. 23, 2019.

(51) Int. Cl.
*E01D 22/00* (2006.01)
*E01D 19/12* (2006.01)

(52) U.S. Cl.
CPC ..... *E01D 22/00* (2013.01); *E01D 19/12* (2013.01)

(58) Field of Classification Search
CPC ..... E01D 22/00; E01D 19/12
USPC ..... 404/75, 93–95; 14/77.1
See application file for complete search history.

(56) References Cited

U.S. PATENT DOCUMENTS

| | | | | |
|---|---|---|---|---|
| 5,215,071 | A * | 6/1993 | Mertes | B28D 7/005 299/39.1 |
| 6,592,289 | B1 * | 7/2003 | Weander | E01C 11/04 404/47 |
| 9,422,678 | B1 * | 8/2016 | Baaske | E01C 23/09 |
| 2009/0107476 | A1 * | 4/2009 | Gobright, IV | B28D 1/045 125/13.01 |
| 2010/0139015 | A1 * | 6/2010 | Bumen | E01D 19/125 249/13 |
| 2019/0134851 | A1 * | 5/2019 | Obrzut | B28D 1/045 |

* cited by examiner

*Primary Examiner* — Raymond W Addie
(74) *Attorney, Agent, or Firm* — Mark A. Goodman, Esq.

(57) ABSTRACT

A concrete deck demolition method for demolishing a concrete deck. The demolition method includes cutting two access windows into the concrete deck, installing a guide rail along a structural beam, making two tilted cuts on an upper surface of the structural beam, supporting the weight of the concrete deck utilizing an arching effect created by the geometry of the tilted cuts and lifting away a concrete deck cut portion for further demolition process.

2 Claims, 5 Drawing Sheets

CONCRETE DECK DEMOLITION SYSTEM AND METHOD

TECHNICAL FIELD OF THE DISCLOSURE

The present disclosure relates generally to concrete deck demolition systems, and more particularly to a system and method for demolishing concrete decks utilizing a double-bladed road-saw having tilted blades. This Application claims the benefit of U.S. Provisional Application 62/925,184 filed on Oct. 23, 2019.

BACKGROUND OF THE DISCLOSURE

Description of the Related Art

Transportation infrastructure plays a vital role in improving quality of life and for the well-being of economy. Among various transportation infrastructures, bridges have a crucial role in connecting people and delivering goods. Bridges must be built strong enough to safely support their own weight as well as the weight of the people and vehicles those pass over it. Bridges typically undergo major deck replacement after about 40 years of service life. Much previous researches have focused on the design and construction of new concrete decks of bridge, but less research and technology has been dedicated towards advanced construction methods for removing existing concrete decks. Current deck removal methods (e.g., saw cutting, jackhammering, and blasting) often damage the bridge superstructure. Sometimes a lack of information on the as-built condition increases the possibility of damaging existing superstructures thereby increasing the cost of deck replacement and delaying the construction progress. Also, noise, vibration, dust, and falling materials associated with traditional deck removal techniques cause environmental and public safety concerns. Consequently, bridge owners and contractors need economic, efficient, and reliable methods for concrete deck removal those prevent the risk of falling pieces of deck or other falling objects and minimize damage to existing superstructures.

Conventional deck demolition methods are ineffective. Generally, there are two methods for demolishing an existing concrete deck slab supported by steel framing. The first method is dismantling in place. This method entails using jackhammers or similar demolition equipment to break apart the concrete in place. Shielding is installed below the deck prior to demolition to catch falling concrete debris. The second method is to panelize the concrete by cutting the slab into rectangular pieces with a straight road-saw. Then, the panels are lifted for further dismantling elsewhere. Both methods have deficiencies. Regarding the first method, jackhammering can be risky and is difficult to control, in particular around a rebar in the concrete slab. Thick shielding below the deck is required to protect against possible large pieces of falling concrete debris. Regarding the second method, temporary support is required for the concrete panel during the road-saw operations so that the panel does not fall straight down. Temporary support can be implemented by providing struts below the deck, or strong backs above the deck. These support providing components increase installation time and cost. The road-saw operations can be performed while the concrete panel is supported under-the-hook. However, this method is risky and unsafe.

Therefore, there is a need for an economic, efficient and reliable method for demolishing concrete deck. Such a method would prevent the risk of falling pieces of deck or other falling objects and would minimize damage to existing superstructures. Further, such a concrete deck removal method would panelize the concrete deck and would lift the deck thereby eliminating the requirement of temporary supports. Such a method would eliminate the presence of loose reinforcing bars which would cause safety risk in the field. The present embodiment overcomes shortcomings in the field by accomplishing these critical objectives.

SUMMARY OF THE INVENTION

To minimize the limitations found in the prior art, and to minimize other limitations that will be apparent upon the reading of the specification, the preferred embodiment of the present invention provides a concrete deck demolition system for demolishing a concrete deck positioned on a structural beam of a bridge. The concrete deck demolition system includes a road-saw machine having a machine housing, a plurality of tilted blades, a guide wheel and a guide rail. The present demolition system utilizes a concrete demolishing method for demolishing the concrete deck. The concrete deck demolition method is based on panelizing the concrete deck and lifting away the panelized decks by eliminating the requirement of a temporary support. The preferred method is initiated by cutting two access windows into an existing concrete deck thereby allowing the plurality of tilted blades of the road-saw machine to provide an initial penetration through the concrete deck. The access windows are located on either side of a top flange or an upper surface of the structural beam. The blades of the double-bladed road-saw are tilted in the shape of an inverted "V" thereby allowing the road-saw to make simultaneous tilted cuts. The guide rail is installed along the length of the structural beam or a steel stringer for enabling the road-saw machine to follow. Two tilted cuts may be made on each side of an upper surface of the structural beam utilizing the tilted blades. Evaluating these tilted cuts from bottom to top, the tilted blades cut towards the center of the beam. These cuts may be made by the road-saw machine or by hydro-saw, a high-pressure water jet cutting machine, wire saw, or any cutting machine fit for this purpose.

As tilted cuts are made, several temporary wedges may be driven into the tilted cuts to prevent a demolished concrete deck cut portion from closing in on the blades, or wire saw, or any mechanical cutting machine. The wedges and the remaining concrete decks or panels prevent the demolished concrete deck cut portion from falling or settling in an undesired manner. After all cuts are made, weight of the concrete deck cut portion will still be supported due to the geometry of the angled cuts creating an arching effect. The concrete deck cut portion can be lifted away for further demolition elsewhere utilizing a rigging and or one or more lifting devices. The preferred method eliminates the presence of loose reinforcing bars which may cause safety risk in the field. Further, the preferred method minimizes damage to the existing structural beams if they are to be reused. Engineering analysis should be performed to ensure that the existing structural beams have the strength to resist the thrust from the arching effect.

It is a first objective of the present invention to provide an efficient and cost effective concrete deck demolition system and a method based on panelizing the concrete deck and lifting away the panelized decks without requiring a temporary support.

A second objective of the present invention is to provide a concrete deck demolition method that utilizes transverse cuts to reduce the length and weight of the demolished concrete deck cut portion for easy lifting and transporting.

A third objective of the present invention is to provide a concrete deck demolition method that eliminates the presence of loose reinforcing bars which cause safety risk in the field.

Another objective of the present invention is to provide a concrete deck demolition method that prevents the demolished concrete decks from falling or settling in an undesired manner.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE INVENTION

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means+/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1:
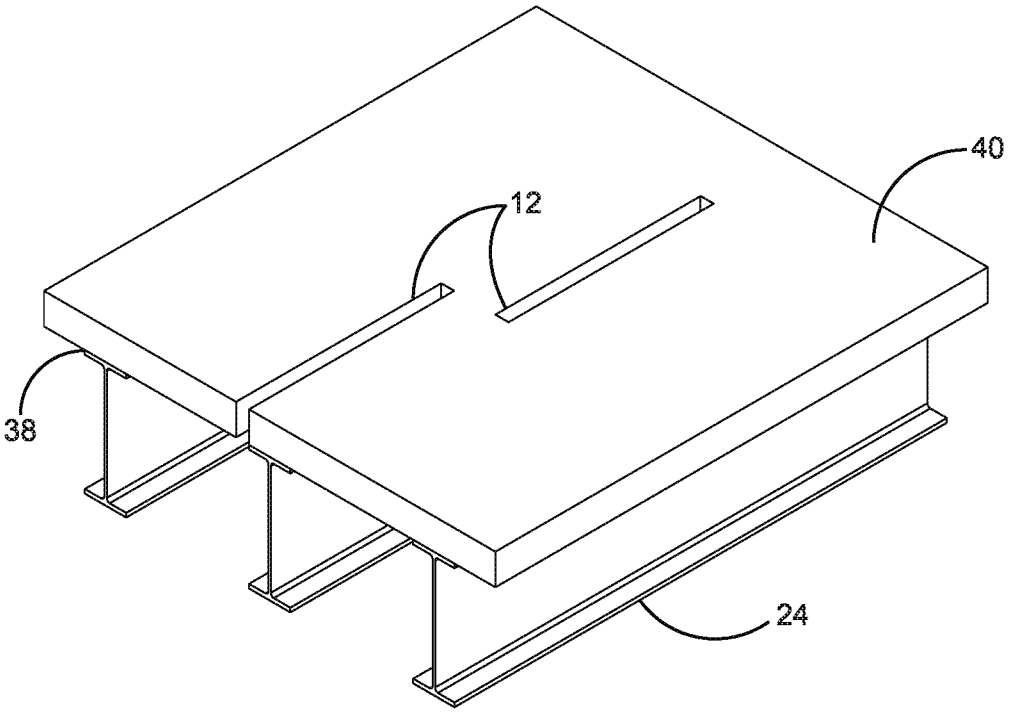
FIG. 1 shows a perspective view of two access windows for demolishing a concrete deck utilizing a concrete deck demolition system according to the preferred embodiment of the present invention.
Figure 2:
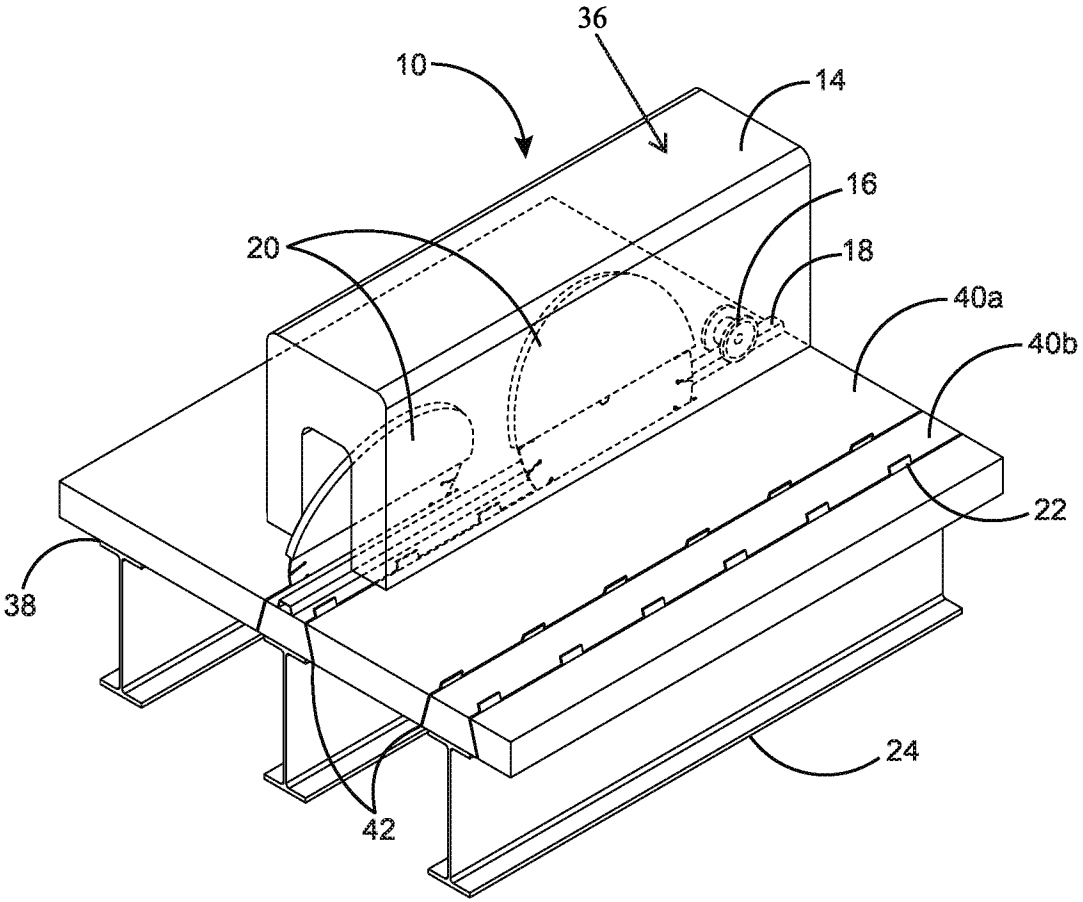
FIG. 2 shows a perspective view of a road-saw machine of the concrete deck demolition system for creating tilted cuts to demolish the concrete deck according to the preferred embodiment of the present invention.

The present invention is a concrete deck demolition system 10 as illustrated in FIG. 2 for demolishing a concrete deck 40 (as shown in FIG. 1) positioned on a structural beam 24 of a bridge. The concrete deck demolition system 10 includes a road-saw machine 36 having a machine housing 14, a plurality of tilted blades 20, a guide wheel 16 and a guide rail 18. In the preferred embodiment, the tilted blades 20 are designed as circular saw blades as shown in FIG. 2. The present system 10 utilizes a concrete demolishing method for demolishing the concrete deck 40. The preferred concrete demolishing method is based on panelizing the concrete deck 40 and lifting away panelized decks without the requirement of any temporary support. As illustrated in FIGS. 1 and 2, the concrete deck demolition method commences by cutting two access windows 12 into an existing concrete deck 40 thereby allowing the plurality of tilted blades 20 of the road-saw machine 36 to provide an initial penetration through the concrete deck 40. The access windows 12 are located on either side of a flange or an upper surface 38 of the structural beam 24. As shown in FIG. 2, the blades 20 of the double-bladed road-saw machine 36 are tilted in the shape of an inverted "V" thereby allowing the road-saw machine 36 to make simultaneous tilted cuts. The guide rail 18 is installed along the length of the structural beam 24 or a steel stringer for enabling the road-saw machine 36 to follow as shown in FIG. 2. Two tilted cuts 42 may be made on each side of an upper surface 38 of the structural beam 24 utilizing the tilted blades 20. The preferred demolishing method could be applied to any type of structural beam 24 or girder including a wide-flange U-beam, I-beam, H-beam, box beam, or a concrete beam. Relative to the position of the upper surface 38 of the top flange of the structural beam 24 (which may be a flange) the tilted cuts 42 would (going from top to bottom) tilt away from the center of the structural beam 24 resulting in the shape of an inverted "V". Evaluating these tilted cuts 42 from bottom to top, the tilted blades 20 cut towards the center of the beam 24. These cuts 42 may be made by the road-saw machine 36 as shown in FIG. 2, or by hydro-saw, a high-pressure water jet cutting machine, wire saw, or any cutting machine fit for this purpose.

As the tilted cuts 42 are made, several temporary wedges 22 may be driven into the tilted cuts 42 to prevent a demolished concrete deck cut portion 40*a* from closing in on the blades 20, or wire saw, or any mechanical cutting machine as shown in FIG. 2. The wedges 22 and the remaining concrete decks or panels 40*b* will prevent the demolished concrete deck cut portion 40*a* from falling or settling in an undesired manner. After all cuts are made, weight of the concrete deck cut portion 40*a* will still be supported due to the geometry of the angled cuts creating an arching effect. This is analogous to how angled cuts are made into the top of a Halloween pumpkin thereby avoiding having the pumpkin top falls inside. Another example is the flat stone arch lintels on top of window openings of a masonry building.

Figure 3:
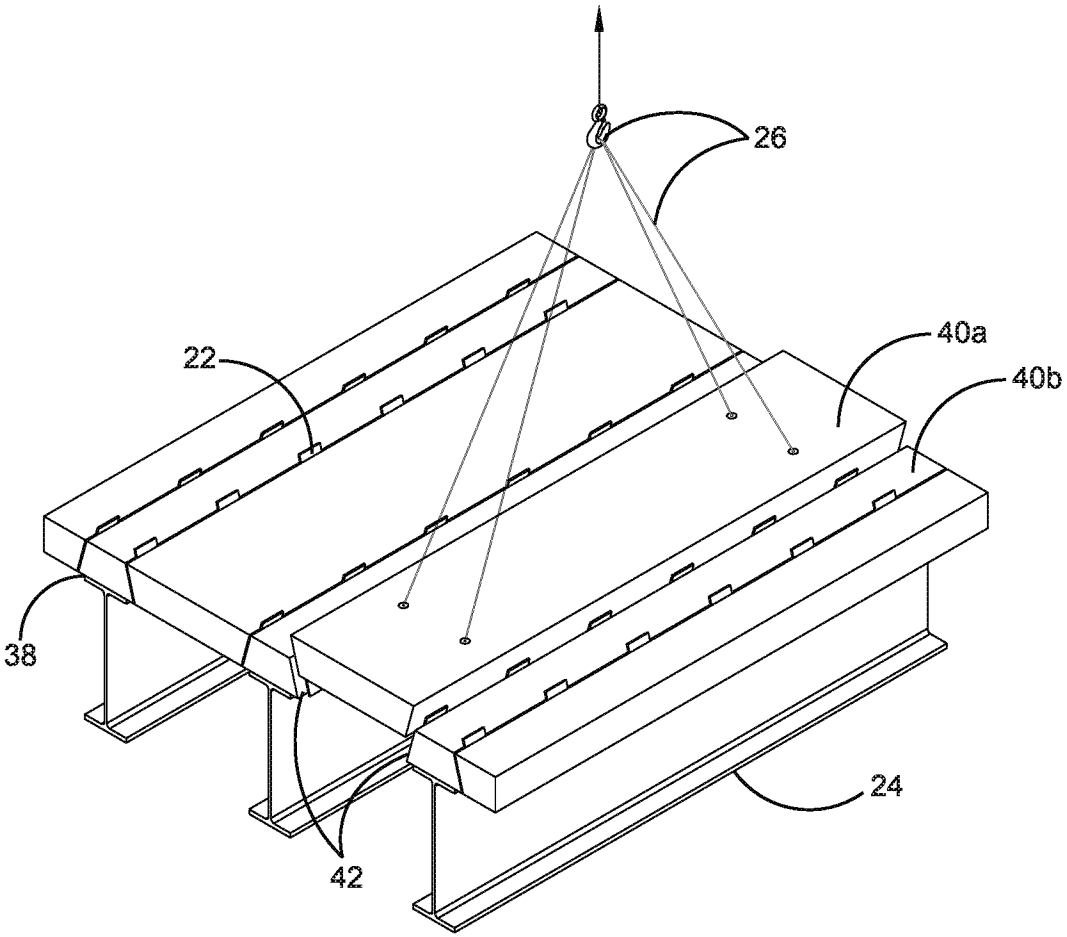
FIG. 3 shows a perspective view of a concrete deck cut portion being lifted away utilizing a rigging of the concrete deck demolition system according to the preferred embodiment of the present invention.
Figures 4A, 4B:
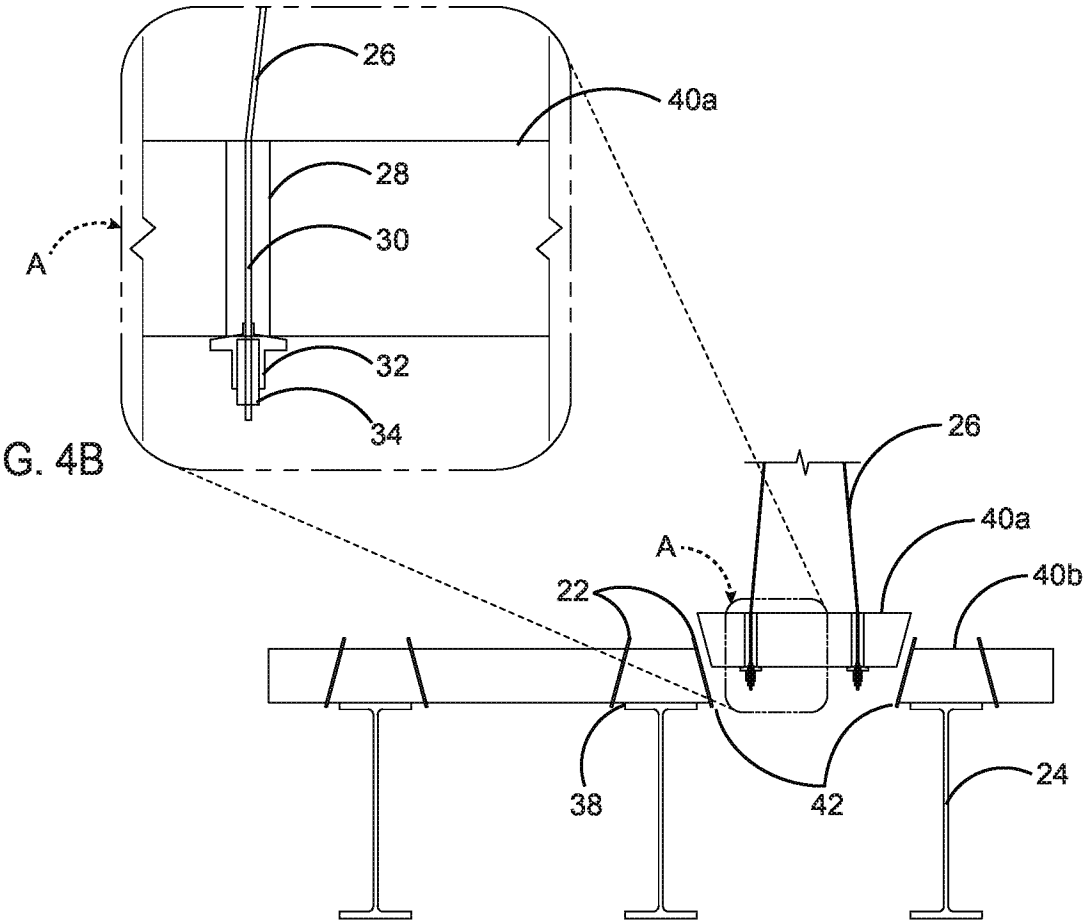
FIG. 4A shows a cross-sectional view of the concrete deck cut portion being lifted away utilizing the rigging of the concrete deck demolition system according to the preferred embodiment of the present invention.
FIG. 4B shows an enlarged view of the rigging of the concrete deck demolition system taken along line A of FIG. 4A according to the preferred embodiment of the present invention.

Preferably, transverse cuts may be needed to reduce the length and weight of each concrete deck cut portion 40*a* for easy lifting and transporting. The concrete deck cut portion 40*a* can be lifted away for further demolition elsewhere utilizing a rigging 26 as clearly illustrated in FIG. 3. The rigging 26 can be installed utilizing core drill 28 and attaching a coffee pot 32, a button stop 34, wire rope slings 30 or similar lifting components as shown in FIGS. 4A and 4B. The preferred method eliminates the presence of loose reinforcing bars which may cause a safety risk in the field. Further, the preferred method minimizes damage to the existing structural beams 24 if they are to be reused. Engineering analysis should be performed to ensure that the existing structural beams 24 have the strength to resist the thrust from the arching effect.

The angle of the tilted cuts 42 relative to the plane of flange or upper surface 38 of the beam 24 (wherein a 0-degree angle would be parallel to the flange and a 90-degree angle would be perpendicular to the flange) would be determined by sound engineering judgment and analysis to ensure the structural integrity of the remaining portion of the structure. Optionally, the angle may be in the range of 45 degrees to 80 degrees.

Figure 5:
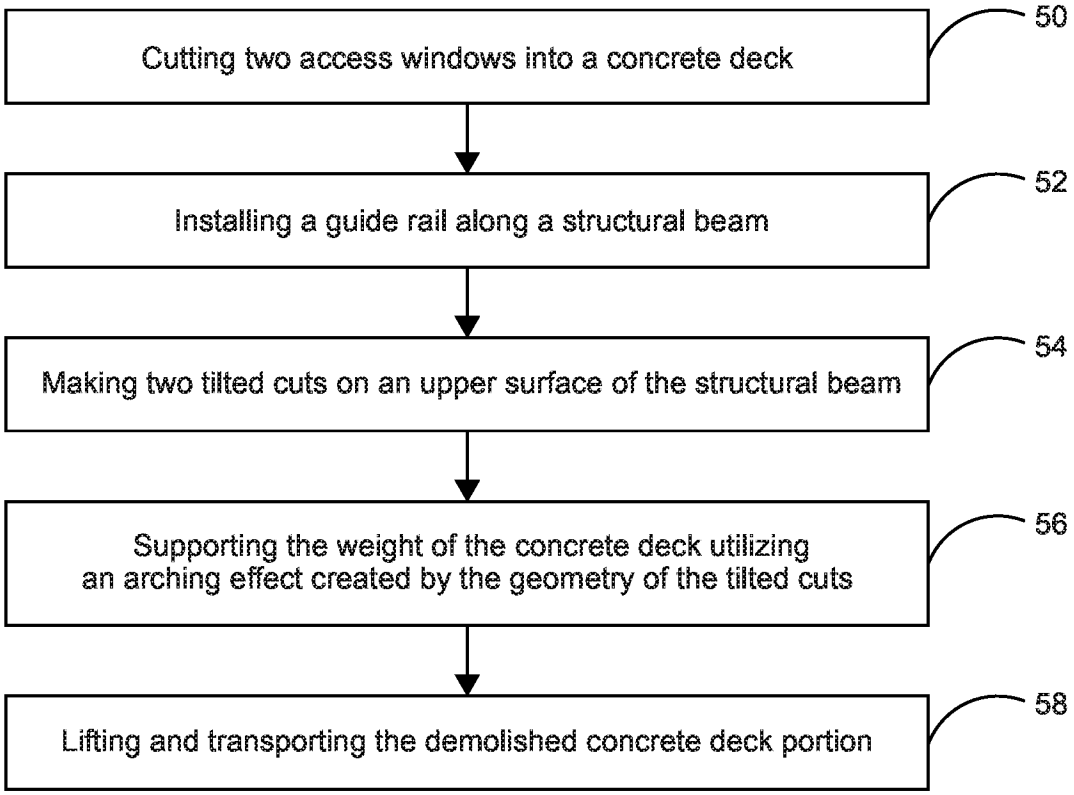
FIG. 5 shows a flowchart of the method for demolishing the concrete deck according to the preferred embodiment of the present invention.

FIG. 5 shows a flowchart of the method for demolishing the concrete deck 10. The method is initiated by cutting two access windows into the concrete deck as shown in block 50. Next, the guide rail is installed along the structural beam as shown in block 52. Then, two tilted cuts are made on the upper surface of the structural beam as shown in block 54. Thereafter, the weight of the concrete deck is supported utilizing an arching effect created by the geometry of the tilted cuts as shown in block 56. Finally, the concrete deck cut portion is lifted and transported for further demolition process as shown in block 58.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A concrete deck demolition method comprising the steps of:

a. cutting two access windows into a concrete deck, the access windows are located on either side of a flange or any other upper surface of an I-beam or H-beam, a box beam, a concrete beam, a steel beam, or any type of structural beam;

b. installing a guide rail along the beam, wherein the guide rail enables a road-saw machine to follow; and c. making two tilted cuts, one on each side of the flange or upper surface of the beam, going from top to bottom, the tilted cuts are tilted away from the center of the beam.

2. A double-bladed road-saw wherein the blades are tilted in the shape of an inverted—"V" thereby allowing the road-saw to make simultaneous tilted cuts.

* * * * *